US007226150B2

(12) United States Patent
Yoshimura et al.

(10) Patent No.: US 7,226,150 B2
(45) Date of Patent: Jun. 5, 2007

(54) INKJET HEAD AND A METHOD OF MANUFACTURING THE SAME

(75) Inventors: Yasuhiro Yoshimura, Tsuchiura (JP); Jun Nagata, Hitachinaka (JP); Osamu Machida, Hitachinaka (JP); Tatsuya Nagata, Tsuchiura (JP)

(73) Assignees: Hitachi, Ltd., Tokyo (JP); Ricoh Printing Systems Co., Ltd., Minato-Ku (JP)

( * ) Notice: Subject to any disclaimer, the term of this patent is extended or adjusted under 35 U.S.C. 154(b) by 191 days.

(21) Appl. No.: 10/890,261

(22) Filed: Jul. 14, 2004

(65) Prior Publication Data

US 2005/0012782 A1 Jan. 20, 2005

(30) Foreign Application Priority Data

Jul. 14, 2003 (JP) ..... 2003-196215

(51) Int. Cl.
*B41J 2/045* (2006.01)

(52) U.S. Cl. ..... 347/68

(58) Field of Classification Search ..... 347/68, 347/70–72

See application file for complete search history.

(56) References Cited

U.S. PATENT DOCUMENTS 5,812,163 A * 9/1998 Wong ..... 347/68
6,213,590 B1 * 4/2001 Fujii et al. ..... 347/54
6,398,349 B1 * 6/2002 Murai ..... 347/68

FOREIGN PATENT DOCUMENTS

| | | |
|---|---|---|
| JP | 5-50601 | 3/1993 |
| JP | 5-309835 | 11/1993 |
| JP | 6-55733 | 3/1994 |
| JP | 3108954 | 9/2000 |
| JP | 3168713 | 3/2001 |

* cited by examiner

*Primary Examiner*—An H. Do
(74) *Attorney, Agent, or Firm*—McDermott Will & Emery LLP

(57) ABSTRACT

An inkjet head is provided and includes: a chamber substrate for forming an ink flow passage; a diaphragm substrate including a diaphragm for pressurizing a pressure chamber disposed in the chamber substrate; and a nozzle substrate for jetting ink pressurized by the diaphragm, wherein the diaphragm substrate is made of silicon, the diaphragm is made of a material selected from the group of silicon oxide film and metal film, and the diaphragm is formed in the diaphragm substrate. A method of manufacturing the inkjet head is also provided.

8 Claims, 10 Drawing Sheets

INKJET HEAD AND A METHOD OF MANUFACTURING THE SAME

CLAIM OF PRIORITY

The present application claims priority from Japanese application No. 2003-196215, filed on Jul. 14, 2003, the content of which is hereby incorporated by reference into this application.

FIELD OF THE INVENTION

The present invention related to an inkjet head, an ink-jet printer and a method of manufacturing the inkjet head. The present invention provides an inkjet head capable of printing at high speed and with high quality.

RELATED ART

In a printer of an inkjet system, high-speed and high quality printing is demanded. In order to increase a printing speed, a line system in which a number of inkjet heads are aligned side by side in such a manner that the lines of the heads transverse the paper face is more advantageous than a serial system in which inkjet heads move in the direction perpendicular to the direction of paper transfer. In order to make printed pictures more precise in the line system printer, it is necessary to narrower the distance between the orifices disposed to the inkjet heads for jetting ink.

In the line system printer, it is necessary to arrange such the number of inkjet heads that they cover the width of the printing paper; particularly in color printers, a great number of inkjet heads because four kinds of lines for black, cyan, magenta, yellow.

An inkjet printer comprises an orifice for jetting ink, a diaphragm for pressurizing ink, a driving device such as a piezo element for vibrating the diaphragm, a pressure chamber for holding pressurizing the ink, and an ink flow passage. From the view point of printing precision, 100 to 400 micrometers of distance between the orifices are needed; and the mechanical micro-processing of the pressure chamber and flow passages is technically very difficult.

There is a method wherein fine flow passages and pressure chambers are formed in a silicon substrate using an anisotropic etching technique of silicon single crystal. An orifice plate formed with the orifice, a diaphragm and a piezo element are bonded on the silicon wafer. There is disclosed a method for fabricating a substrate having an ink storage and an ink pressure chamber using the anisotropic etching of silicon single crystal in Japanese Patent No. 3,168,713. Although grooves and holes can be formed by utilizing dependency of an etching rate on crystal aspect of a wet etching of silicon single crystal, there is no discretion of machining shapes; and the optimum design of flow passages, etc. becomes difficult because of limitation of the machining direction due to the crystal aspect of the silicon single crystal, on the other hand. Thus, in recent years, dry etching processes such as a plasma etching process are proposed, instead of the wet etching process of silicon single crystal.

Japanese Patent Laid-open Hei 5-50601 (1993) discloses an inkjet head comprises a plurality of nozzle holes, jet chambers each being independent and connected with each of the jet chambers, a vibration plate is constituted by a part of the wall of the chamber which can mechanically deform, a driving means for driving the vibration plate, and an ink cavity for supplying ink to the chambers and being common to the jet chambers. The vibration plate and the ink cavity are formed by anisotropic etching is applied to the silicon substrate, thereby to prepare the nozzle substrate.

Further, in Japanese Patent No. 3,108,954 discloses an inkjet head comprising a silicon substrate formed with an ink chamber, an ink storage, and a glass vibration plate being bonded to the substrate by anodic bonding.

In the process disclosed in Japanese Patent Laid-open Hei 5-50601, it is difficult to arrange the vibration plate, i.e. inkjet nozzles with a narrow pitch, because the vibration plate made by anisotropic etching of silicon single crystal has inclined faces at the ends thereof so that the inclined face portions become dead space.

In the process disclosed in Japanese Patent No. 3,108,954, where the glass vibration plate is anodic-bonded, the glass vibration plate needs a certain thickness for handling it so as to prevent its breakage so that it is difficult to attain high jet speed.

SUMMARY OF THE INVENTION

The present invention provides an inkjet head comprising;

a chamber substrate for forming an ink flow passage;

a diaphragm substrate including a diaphragm for pressurizing a pressure chamber disposed in the chamber substrate; and a nozzle substrate for jetting ink pressurized by the diaphragm, wherein the diaphragm substrate is made of silicon, the diaphragm is made of a material selected from the group of silicon oxide film and metal film, and the diaphragm is formed in the diaphragm substrate.

The present also provides a method of manufacturing an inkjet head comprising a chamber substrate for forming a flow passage, a diaphragm substrate having a diaphragm for pressurizing a pressure chamber disposed to the chamber substrate, and a nozzle substrate for jetting ink pressurized by the diaphragm, which comprises dry-etching both surfaces of a silicon wafer to prepare a diaphragm made of silicon dioxide.

DESCRIPTION OF THE PREFERRED EMBODIMENTS

In the following, embodiments will be explained with reference to drawings.

Figure 1:
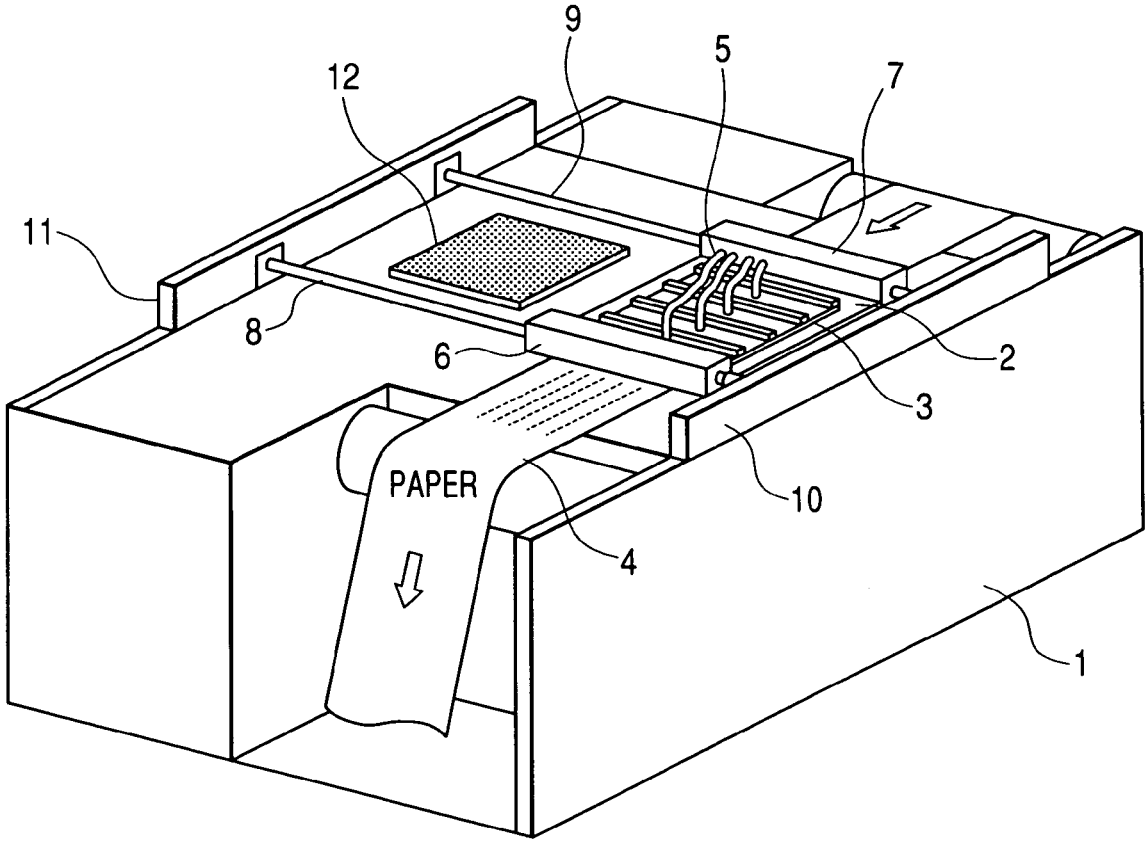
FIG. 1 is a perspective view of an inkjet printer of an embodiment according to the present invention.

FIG. 1 is a perspective view of an inkjet printer that uses an inkjet head of an embodiment according to the present invention. In FIG. 1, a head bace 2 is formed on the top of a casing 1. There are disposed four rows of inkjets 3, the rows being arranged to transverse the moving direction of a printing paper 4. Inside of the casing 1, a roll paper transfer, a controller, etc. are installed, which are not shown. To each of the four inkjet head rows 3, black, cyan, yellow and magenta inks are supplied by way of each of four ink supply tubes 5, so as to make color printing.

Figure 2:
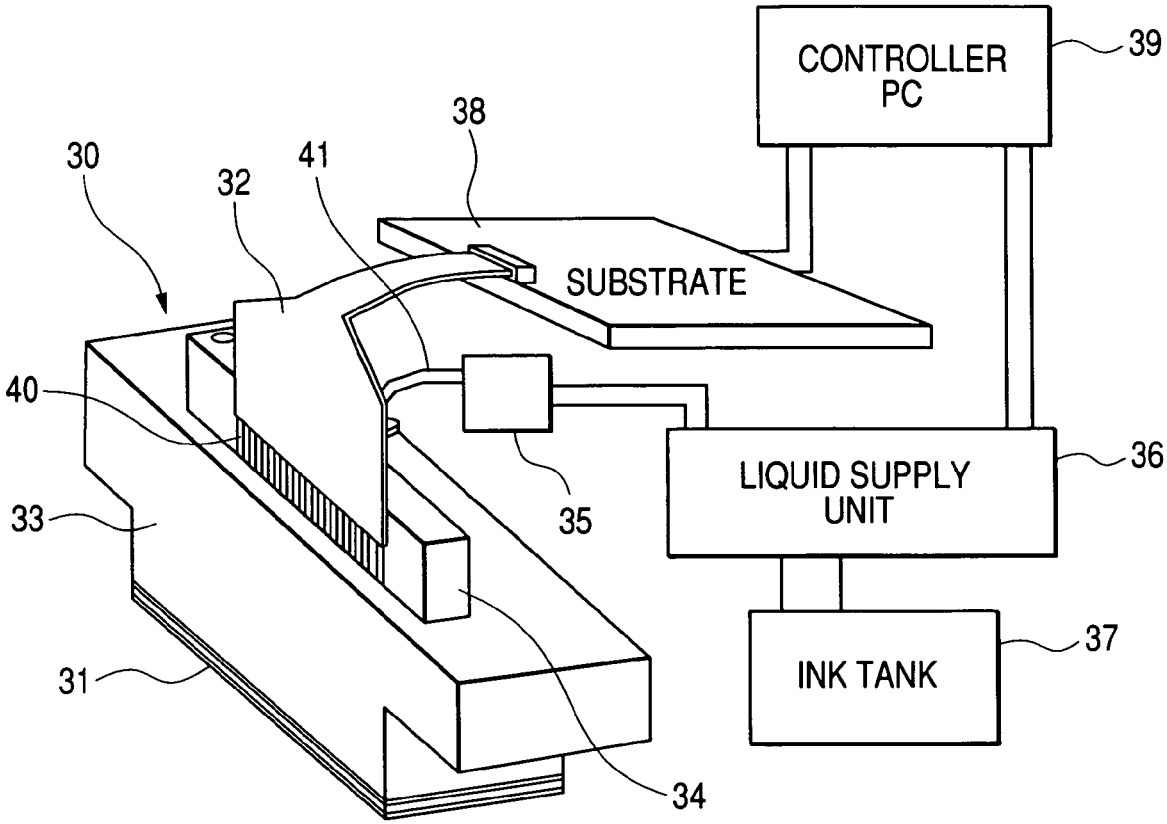
FIG. 2 shows a perspective diagrammatic view of an essential structure of an inkjet printer of the embodiment according to the present invention.
Figure 6:
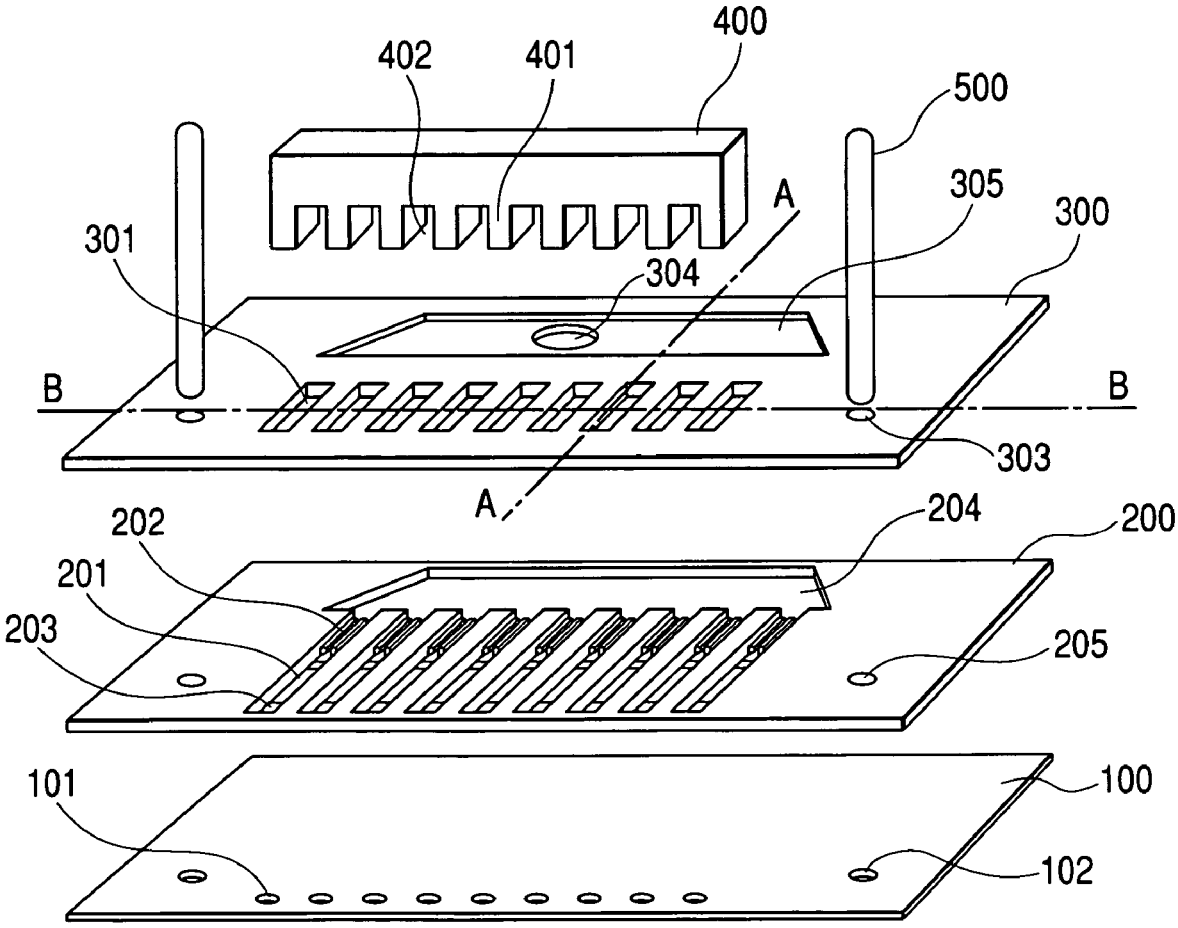
FIG. 6 is an explosion view of a head plate.
Figure 7A:
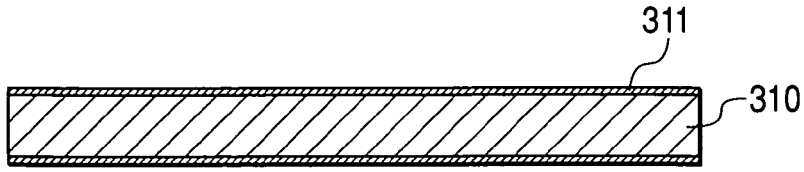
FIG. 7 is a flow chart of a process for machining a diaphragm substrate.
Figure 7B:
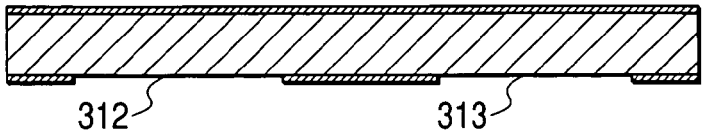
Figure 7C:
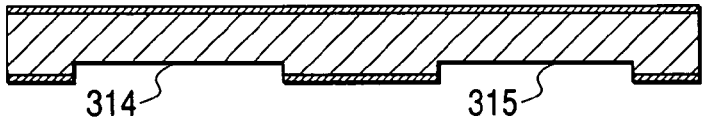
Figure 7D:
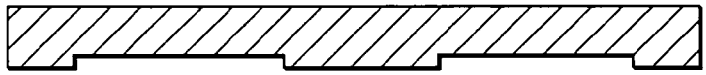
Figure 7E:
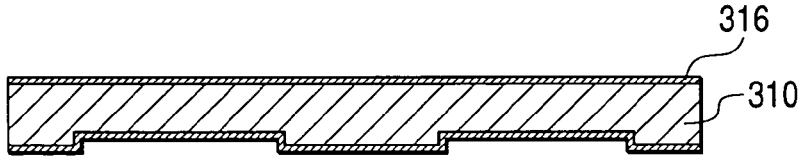
Figure 7F:
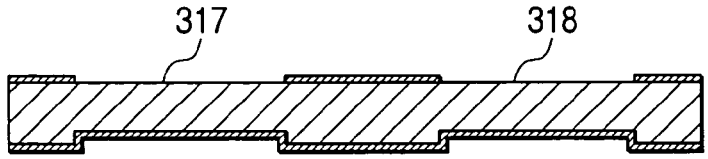
Figure 7G:
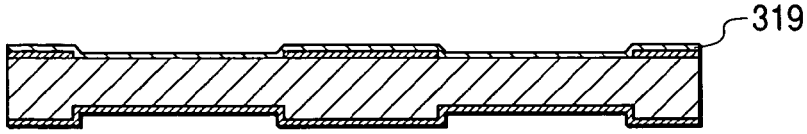
Figure 7H:
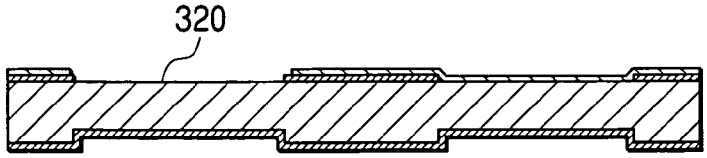
Figure 7I:
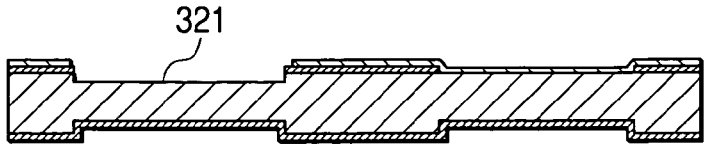
Figure 7J:
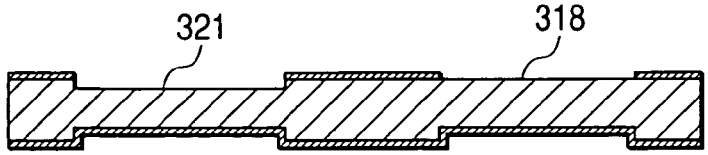
Figure 7K:
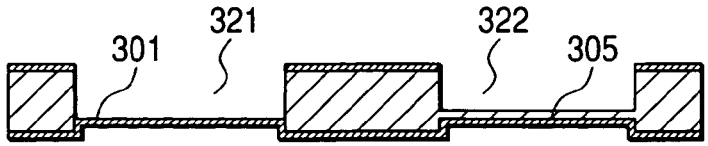

To each of the head rows 3, there are 20 inkjet heads 30 shown in FIG. 2, which are arranged in the direction perpendicular to the moving direction of the printing paper; that is, the direction perpendicular to the lengthwise direction of the roll paper in the same plane. To each of the inkjet head 30, 128 of nozzles 101 shown in FIG. 6 are disposed. Printing paper 4 is so transferred as to transverse the nozzles 101 shown in FIG. 6. In this figure, the printing paper is moved in the direction of arrow shown in FIG. 1. There is disposed at the upstream of the paper the roll paper supply device which is not shown.

Between the frames 10, 11 on the casing 1, there are disposed rods 8, 9, on which supporting members 6, 7 can slide. Since the head base 2 is fixed to the supporting members 6, 7, each of the head rows 3 can move in the direction perpendicular to the lengthwise direction of the printing paper 4 until the position of the head cleaning mechanism 12.

Figure 3:
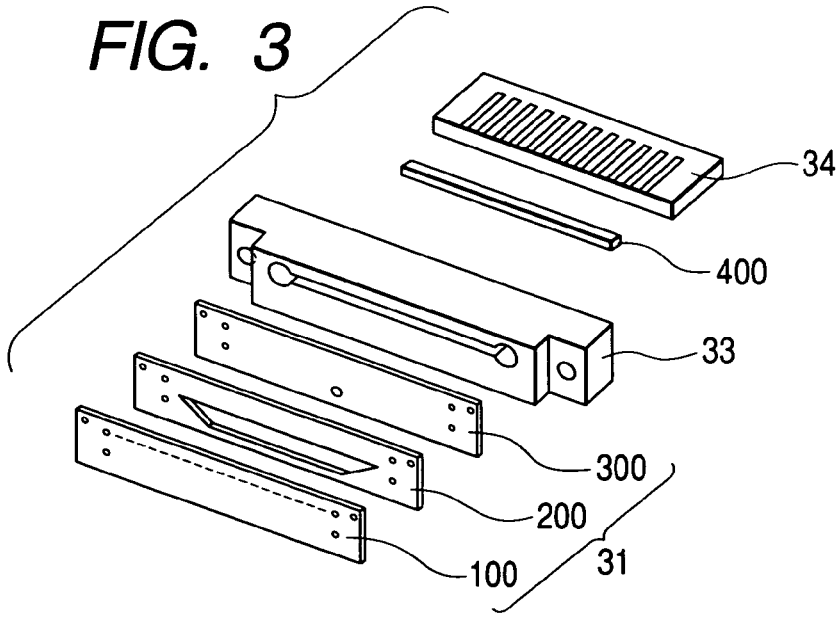
FIG. 3 is an explosion view of an inkjet head of the embodiment.
Figure 4:
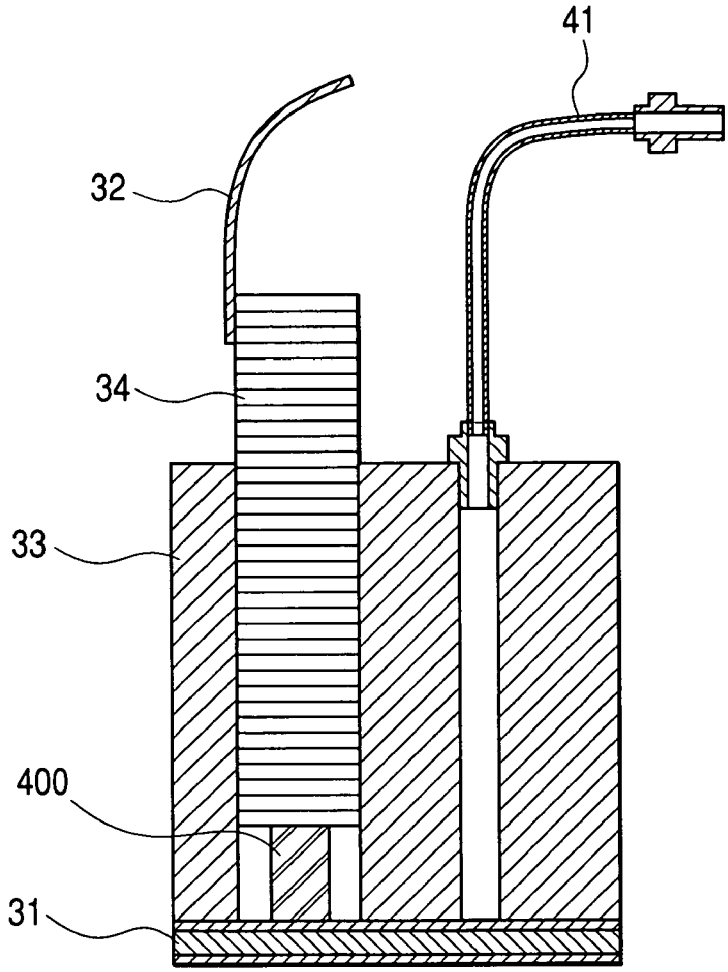
FIG. 4 is a vertical cross sectional view of the ink-jet head of the embodiment of the present invention.

In FIG. 2, the inkjet head 30 comprises orifices for jetting out ink, diaphragms and pressure chambers for pressurizing ink, ink passages, an ink storage, a head plate 31 having a plurality of damper plates for absorbing pressure, a piezo element 400 shown in FIG. 3 connected to the diaphragms, a back-plate for fixing the piezo element 34, and a housing for encasing and fixing the piezo element 400 and the back-plate 34.

The head-plate 31 is fixed to the end face of the housing 33. A flexible plate 32 that supplies driving current to the piezo element 400 is connected to a control circuit board 38.

Printing ink is stored in an ink tank unit 37; the ink is supplied by means of a liquid supply unit 36 for controlling amounts of ink through pressure and a filter 35 for removing dust, etc. to the inkjet head 30. The ink tank 37 is of a cartridge type; when ink is consumed, the cartridge is replaced with a new one.

The control circuit board 38, the liquid supply unit 36 and ink tank unit 37 are connected to a controller personal computer 39, whereby to control driving of the piezo element 400 and ink supply in accordance with inputted printing information. The controller personal computer 39 detects the residual amount of ink in the ink tank unit 37 and issues an alarm for shortage of ink.

In order to conduct a stable inkjet, the temperature of the inkjet head 30 is controlled by a heater to be constant.

In FIG. 3, the inkjet head comprises a head plate 31, which is a laminate of the nozzle plate 100, an ink chamber substrate 200 and a diaphragm substrate 300. The head plate 31 is connected to the end face of the housing 33. The piezo element 400 is fixed to the diaphragm plate 300; the back plate 34 is fixed to the piezo element; and the back plate 34 is fixed to the housing 33. The housing 33 is provided with an ink tube 41 that communicates with the ink supply tube 5.

Figure 5:
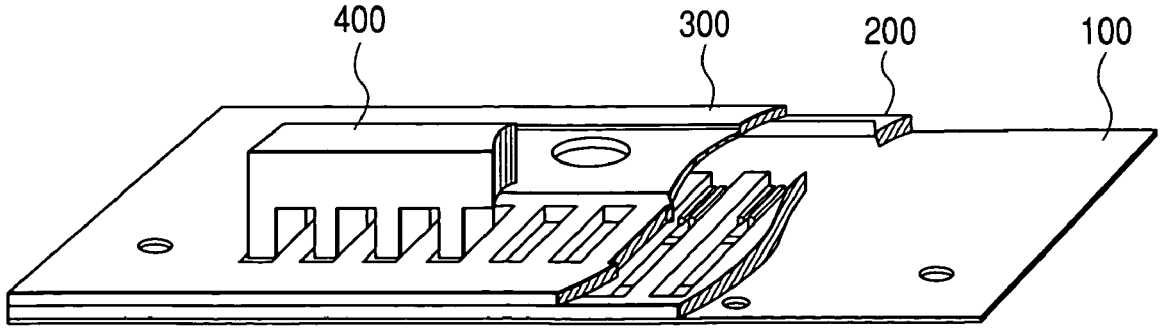
FIG. 5 is a partially broken-away, perspective view of the inkjet head.

In FIG. 5, the ink chamber 200 is provided with a pressurizing chamber section, flow passage section and ink storage section. The nozzle substrate 100 and the diaphragm substrate 300 are closely contacted with each other through the chamber substrate 200, thereby to form ink flow passages.

In FIG. 6, there are formed a number of nozzles 101 and positioning holes 102 for assembly in the nozzle plate 100. The chamber substrate 200 is provided with through-holes 203 that communicate with the nozzles, pressure chambers 201 for pressurizing ink, restrictors 202 for preventing back-flow of ink when pressurized, an ink storage 204 and positioning holes 205.

The diaphragm substrate 300 is provided with diaphragms 301, an ink intake port 304 and positioning holes 303. The piezo element 400 is provided with slits 402 each corresponding to each of the nozzles 101. The projected portions 401 are connected to the diaphragms 301 of the diaphragm substrate 300. Positioning pins 500 are used for assembly. The positioning pins are inserted into the positioning holes 102, 205, 303.

As an example, a silicon wafer is thermal oxidized to form a silicon dioxide film on the surfaces thereof. One of the silicon oxide film is formed with a pattern of a diaphragm opening and a damper opening by a lithographic method. Then, the diaphragm opening and the damper opening are formed by dry-etching process using the silicon dioxide having the pattern as an etching mask.

Thereafter, the silicon dioxide film is removed, and again the silicon wafer is thermal oxidized to form silicon dioxide film. The silicon dioxide film on the surface of the other side is provided with a pattern having a window for a diaphragm groove and a window for a damper groove for preparing a diaphragm and a damper plate by a lithographic method. On the surface of the pattern, an aluminum film is formed. The diaphragm groove is etched by the halfway using the aluminum film as an etching mask by dry-etching method. Then, after the aluminum film is removed, the diaphragm groove and the damper plate are formed simultaneously by dry-etching using the silicon dioxide film as an etching mask so as to prepare the diaphragm substrate having the diaphragm made of silicon dioxide and the damper plate made of two layers of silicon and silicon dioxide.

After the diaphragm groove is completely opened, over-etching is carried out to make the diaphragm substrate, removing burrs or flashes on the diaphragm groove.

On the surface of the diaphragm opening side of the diaphragm substrate, a borosilicate glass layer if formed or the borosilicate layer is formed after a metal film is formed. Thereafter, a diaphragm grove and a damper groove is formed. The metal film strengthens or reinforces the diaphragm to prevent its breakage. The borosilicate glass is formed for anodic bonding with the chamber substrate.

The periphery of the window or opening for the diaphragm groove formed in the aluminum film used for forming the diaphragm groove to the halfway is larger than that of the window or opening for the diaphragm groove formed in the silicon dioxide for simultaneously forming the diaphragm groove and the damper groove.

The present invention also provides an inkjet head and an inkjet printer having the inkjet head that is preferably manufactured by the above-mentioned method. The material of the diaphragm substrate is silicon, and the material of the diaphragm is silicon dioxide or a combination of silicon dioxide film and metal film. The diaphragm of the inkjet head is formed inside of the diaphragm substrate.

The material of the diaphragm is the same as a film formed in the surface of the flow passage. The diaphragm is formed at a position remote from the ink passage. The diaphragm gets into the inside of the ink chamber substrate. The diaphragm can be provided with a borosilicate glass film and/or a metal film on the silicon dioxide film on the bonding side. The silicon dioxide film for the diaphragm can be sandwiched by metal films.

At least a part of the diaphragm has a round periphery.

As shown in FIG. 7, a silicon wafer (100) 310 having a thickness of 200 μm is heated at 100° C. in oxidizing atmosphere to form silicon oxide films 311 on the opposite surfaces thereof (first and second surface) in step (a). The films have a thickness of 1.4 μm, for example.

Then, a pattern having a diaphragm opening 312 for forming diaphragms 301 and damper opening 313 for forming a damper plate 305 is formed on the silicon dioxide film 311 of the silicon wafer 310 on the first surface (lower surface in FIG. 7(*b*)). Thereafter, a diaphragm opening 314 and a damper opening 315 are formed by dry-etching about 20 μm of the first surface of the silicon wafer 310 using the silicon dioxide film as a mask in step (c). In this step, dry-etching is carried out using a dry-etching apparatus such as ICP-RIE (ICP stands for inductively coupled plasma, and RIE stands for Reactive Ion Etching).

Then the silicon dioxide films 311 of silicon wafer 310 on the both surfaces are removed with a mixed acid containing hydrogen fluoride acid and ammonium fluoride. By this treatment, the process of the first surface is completed. Then, the other surface (second surface) is processed. The silicon wafer 310 processed in the previous steps is again thermal-oxidized to form silicon dioxide film of 2 μm on the wafer 310.

Then, a pattern having a window for a diaphragm groove 317 for making the diaphragm and a window for a damper groove 318 for making the damper is formed on the silicon dioxide film 316 (the other surface of silicon wafer 310) on the second surface by the photo-lithographic process. The remaining silicon dioxide film 316 is used as an etching mask at step (f) for the first layer, and the patterned aluminum film 319 is used for the second etching mask.

Then, an aluminum film 319 having a thickness of about 0.5 μm is deposited by a sputtering method on all over the exposed surface of the silicon wafer 310 as shown in step (g). Thereafter, formed is a pattern having a window for the diaphragm groove 320 in the aluminum film, which is a second mask at step (h) by the photo-lithographic process. A photo-mask for photo-lithographic process is designed so that the diameter of the window for the diaphragm groove 317 formed in the aluminum film is larger than that of the window for the diaphragm groove formed in the silicon dioxide film.

Then, the second surface of the silicon wafer 310 is subjected to dry-etching using the aluminum film as a dry-etching mask to etch out about 50 μm to make diaphragm groove 321 to the halfway at step (i). In this step, the dry-etching is carried out by the ICP-RIE apparatus.

Then, the aluminum film 319 is removed with a hydrofluoric acid solution of 1% at step (j). Thereafter, the second surface of the silicon wafer 310 is subjected to etching using the silicon dioxide film as the etching mask by about 130 μm to make the diaphragm groove 321 and the damper groove 323 simultaneously at step (k). Further, the over-etching is carried out to completely remove remaining silicon around the wall of the etched bottom of the diaphragm groove, thereby to obtain a 20 μm-thick damper plate.

The above is the process for manufacturing the diaphragm substrate 300 having the diaphragm 301 made of silicon dioxide. Since the mechanical strength of the diaphragm of silicon dioxide is low, it may be preferable to strengthen it by forming thereon a metal film made of titanium, chromium, gold, etc. in the post processing. The process for preparing the strengthening film can be practiced prior to the dry-etching at the step (i). In this case, since the size of the window for the diaphragm groove 320 is larger than that of the window for the diaphragm groove 317, the processed size of the diaphragm groove by the dry-etching process is determined by the smaller window size of the diaphragm groove 317. Therefore, even if displacement of the silicon dioxide film 316 and the aluminum film 319 occurs at the second photo-lithographic process, the displacement can be absorbed. The etching depths can be adjusted in accordance with performance of the inkjet heads.

The dry-etching process is different from the wet-etching process in that the former is applied to any shapes of etching patterns. However, as for etching depths, fluctuation in depth in the plane is larger than that of the wet-etching process. Accordingly, when the vibration plate is silicon, which is prepared by forming a hole with the dry-etching process of silicon wafer, fluctuation of thickness of the diaphragm occurs. This does not result in a diaphragm with a high precision so that the fluctuation of jetted ink occurs.

On the other hand, when the diaphragm is made of silicon dioxide, the thickness of the film is determined by the silicon film to produce a diaphragm with a constant thickness.

Figure 8A:
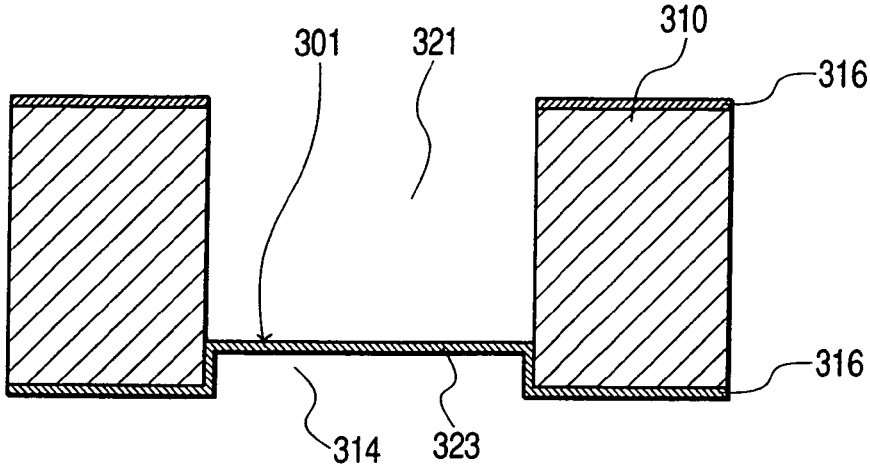
FIG. 8*a*, FIG. 8*b* and FIG. 8*c* show cross sectional views of different embodiments along the line B—B in FIG. 6.
Figure 8B:
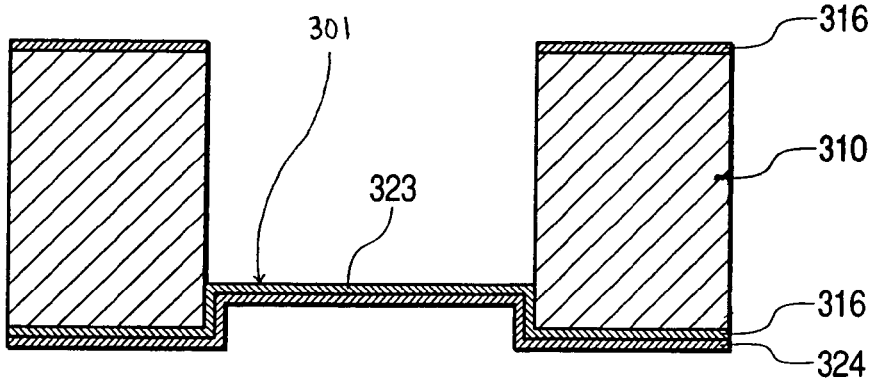
Figure 8C:
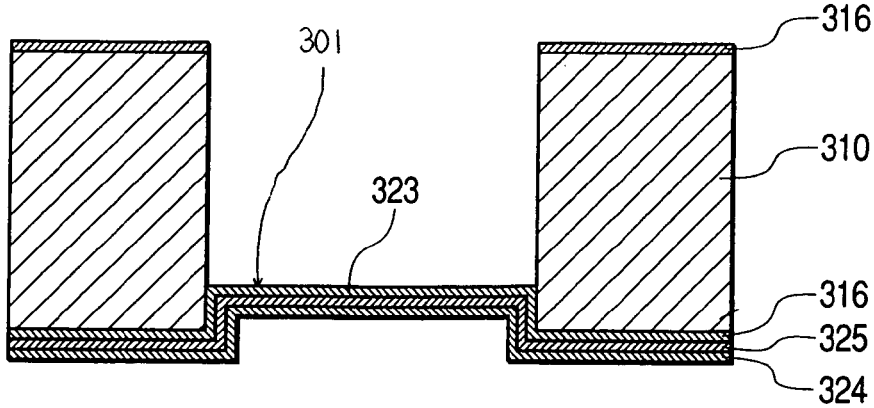

FIGS. 8*a* to 8*c* show one diaphragm unit of the cross sectional view along the line B—B in FIG. 6. In FIG. 8*a*, the diaphragm portion comprises a diaphragm 301 of silicon dioxide, a diaphragm opening 314 and a diaphragm groove 321. The diaphragm 310, which is the diaphragm film 323 is a continuous film continued to the silicon dioxide film 316 at the side of the opening 314. Therefore, the silicon dioxide film is formed on the wall of the diaphragm opening 314.

FIG. 8*b* shows a structure of the diaphragm 301 in case where the diaphragm substrate 300 and the ink chamber substrate 200 are bonded by anodic bonding. The surface of the diaphragm opening is the bonding face with the ink chamber substrate 200. A borosilicate glass film 324 of a thickness of 1 μm or more is formed on the surface at the side of the diaphragm opening of the diaphragm 301.

FIG. 8*c* shows a structure wherein a titanium film 325 is formed between a borosilicate glass film 324 shown in FIG. 8*b* and a silicon dioxide film including a diaphragm film 323. In this embodiment, though anodic bonding is not employed, a two layers structure of the diaphragm film 323 and the titanium film 325 is employed when the silicon dioxide film is reinforced.

Figure 9A:
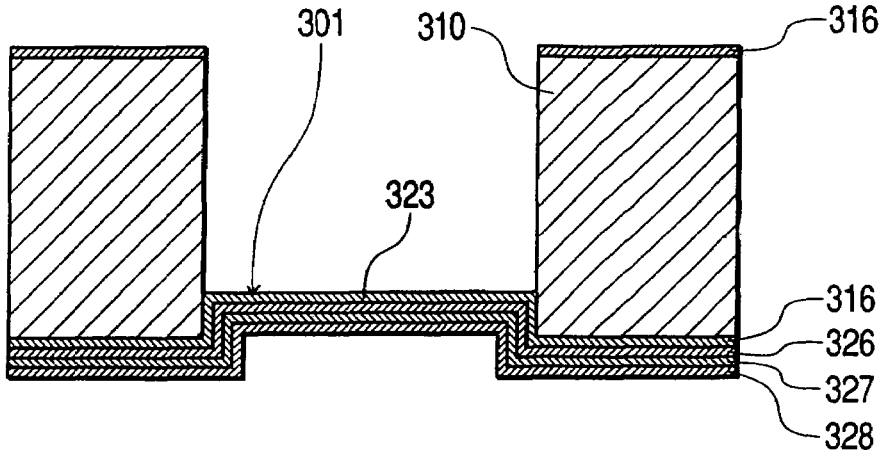
FIG. 9*a* and FIG. 9*b* show cross sectional views of different embodiments of the diaphragm.

FIG. 9*a* shows an example that does not employ the anodic bonding, but that the diaphragm substrate and ink-chamber substrate are assembled by bonding. The reinforcing film of gold having a larger malleability (i.e. softer or malleable) than titanium or chromium is formed to reinforce the diaphragm 301 of silicon dioxide film. A titanium film 326, a gold film 328 and a titanium film 328 are formed on the silicon dioxide film 316 including the diaphragm film 323. Since gold is softer than titanium, the diaphragm 301 is prevented from breakage. Further, since the adhering property of the gold film to the borosilicate film or silicon dioxide film is poor, the titanium film that improves the adhering property is formed between the silicon dioxide film and the gold film.

Figure 9B:
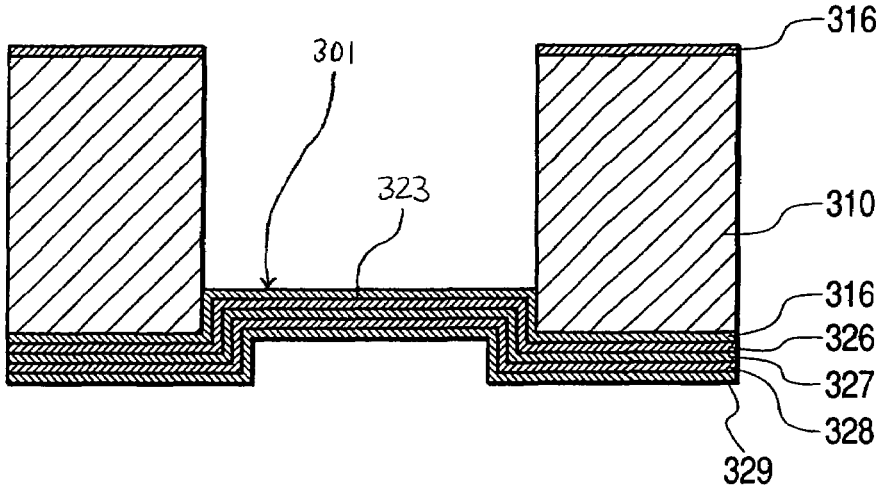

FIG. 9*b* shows a structure where the laminated diaphragm shown in FIG. 9*a* is subjected to anodic bonding. Thus, a borosilicate glass film 329 is formed on the outer face of the titanium film 328.

Figure 10:
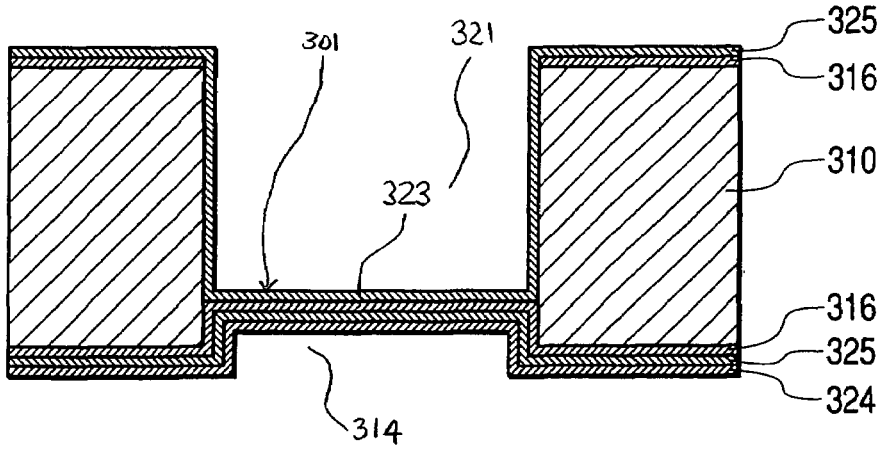
FIG. 10 is a cross sectional view of a part of the diaphragm substrate.

FIG. 10 is another embodiment wherein the diaphragm film 323 is reinforced by sandwiching the film 323 with layers on both sides of the diaphragm opening 314 and the diaphragm groove 321. A silicon dioxide film 325, a titanium film 325 and a borosilicate glass film 324 are laminated on the diaphragm opening side, and on the diaphragm groove side, a titanium film 325 extending over the whole surface of the diaphragm film 316 and the silicon wafer 310. The laminated films on the opening side are also so formed as to cover the whole surface of the diaphragm film 316 of silicon dioxide film. The titanium film 326 is formed on the silicon dioxide 316 at the diaphragm groove 321 side. If anodic bonding of the diaphragm to the ink chamber 200 is not needed, the borosilicate film can be omitted.

In place of the titanium film 325, 326, 328, a chromium film or silicon nitride film can be used. If a material for the reinforcing film is well adhered or intimate with the silicon dioxide film, other metal films or ceramic films are acceptable. A thickness of the above-mentioned reinforcing films is preferably 0.1 to 0.5 μm. When the gold film is used as the reinforcing film, a thickness of the titanium or chromium films is preferably about 0.05 μm.

Figure 11A:
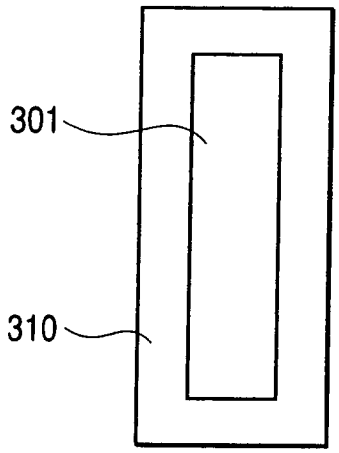
FIG. 11*a* and FIG. 11*b* show top views of embodiments of the diaphragm.
Figure 11B:
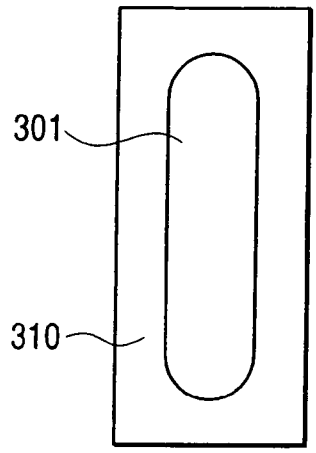

FIG. 11*a* and FIG. 11*b* are top views of diaphragms of different embodiments. In case of FIG. 11*a*, the diaphragm 301 of square shape, and in case of FIG. 11*b* the diaphragm 301 has a long circle shape. When the diaphragm 301 is vibrated, a stress is concentrated at the corners of the diaphragm in case of FIG. 11*a*, but in case of FIG. 11*b*, there is no concentration of the stress at the corners. Therefore, the thickness of the diaphragm 301 can be thinner in case of FIG. 11*b* than in case of FIG. 11*a*. As a result, a vibration amplitude of the diaphragm can be made larger to increase an amount of inkjet. Further, since the diaphragm film is less breakable, the handling of the diaphragm becomes better in assembling it, and a yield rate of the products becomes higher.

Figure 12A:
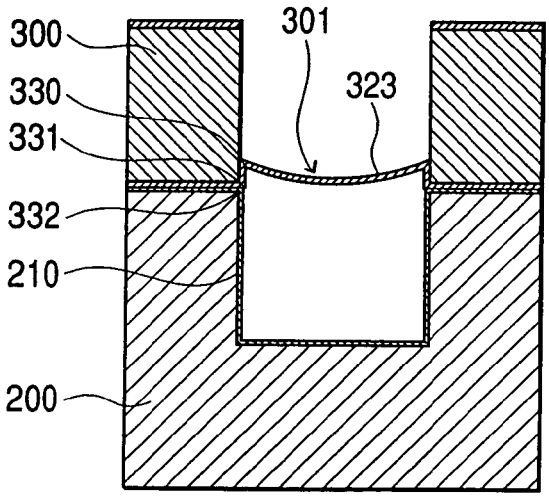
FIG. 12*a* and FIG. 13*a* show cross sectional views of anodic bonded portions between the diaphragm substrate and the ink chamber substrate of different embodiments.
Figure 12B:
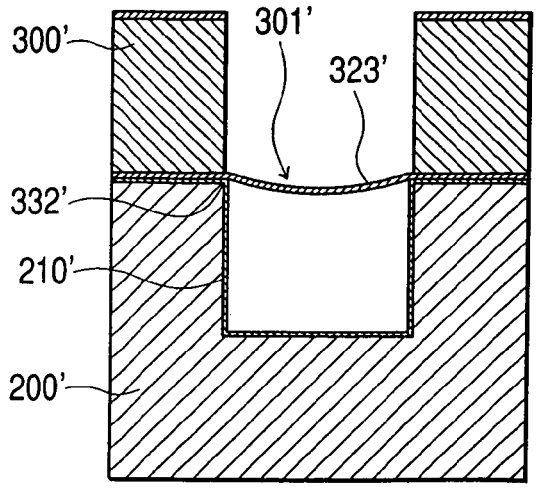
FIG. 12*b* and FIG. 13*b* show cross sectional views of comparative embodiments, which are not prior art.
Figure 13A:
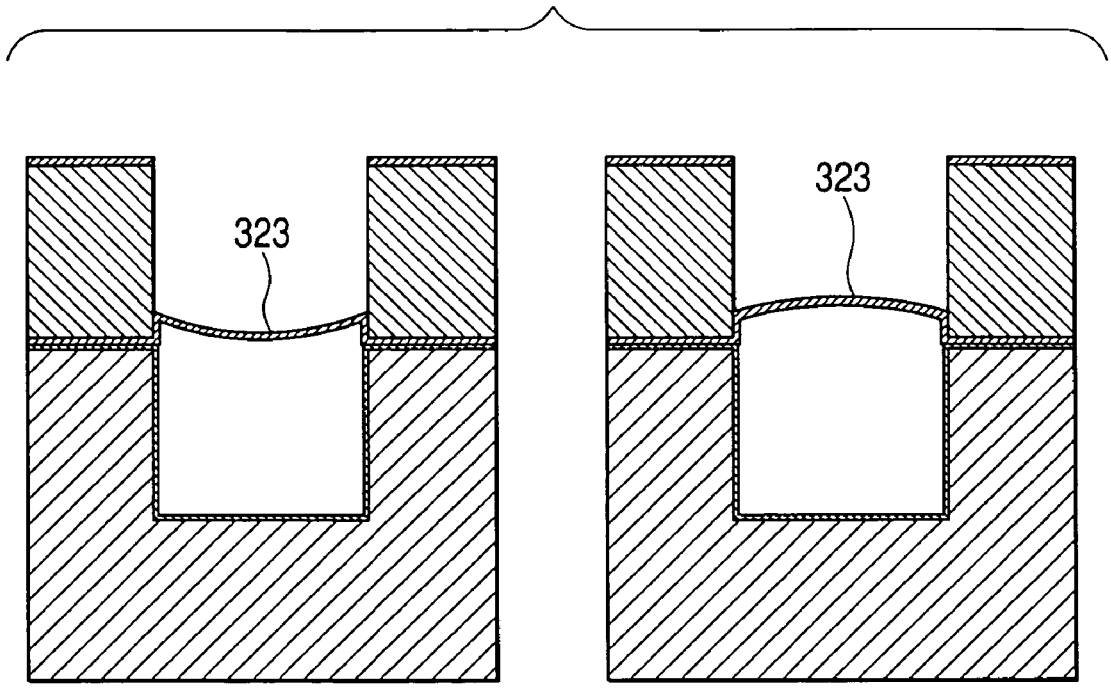
Figure 13B:
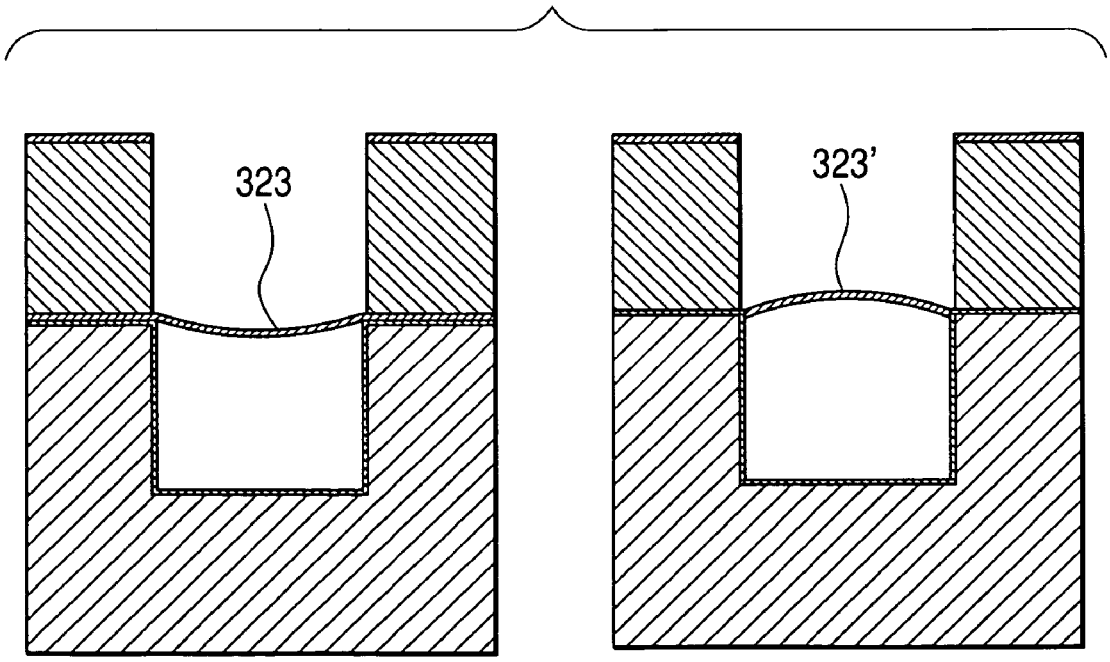

FIG. 12*a* and FIG. 12*b* show the anodic bonded statuses between the diaphragm substrate 300 and the ink chamber substrate 200. FIG. 13*a* and FIG. 13*b* show statuses of vibration of the diaphragms 323. The left side drawings in FIG. 13*a* and FIG. 13*b* show the statuses that the diaphragm films 323 move downward by the action of a piezo element (not shown), and the right side drawings in FIG. 13*a* and FIG. 13*b* shown the statuses that the diaphragm film 323' move upward by the action of the piezo element (not shown). The diaphragm films 323, 323' repeat the movement between the left side and the right side by the action of the piezo element, thereby to effect flowing of the ink by changing the volume of the pressure chamber. FIG. 12*b* and FIG. 13*b* show comparative embodiments, wherein the diaphragm 301' is formed on the surface of the diaphragm substrate 300'. The reference numerals with primes Show the corresponding parts of FIG. 12*a* and FIG. 13*a*. Since the diaphragm 301' is thermal silicon dioxide, the diaphragm film is curved downwardly as shown in FIG. 12*b*; the top portion of the curved diaphragm may touch with the ink chamber substrate in adjusting and bonding the diaphragm, which leads to breakage and lowers a yield rate of the products. Further, the diaphragms shown in FIG. 12*b* and FIG. 13*b* may be destroyed during handling.

On the other hand, in cases of FIG. 12*a* and FIG. 13*a* that show embodiments of the present invention, since the diaphragm 301 is formed on the inner wall of the groove of the diaphragm substrate 300, the top portion of the diaphragm 301 does not touch with surroundings, particularly with the ink chamber substrate to increase an yield rate of the products. That is, the diaphragm film is not broken by contacting with the ink chamber at the time of alignment of diaphragm substrate and ink chamber substrate for bonding them or by contacting with jigs, etc at the time of handling the diaphragm film after processing of the diaphragm substrate.

Since a thin silicon dioxide film 210 is formed on the inner surface of the ink chamber 200 to increase wettability to ink and since the diaphragm is silicon dioxide, the ink chamber is well wetted with ink so that inclusion of voids into the ink chamber is avoided in filling ink. This is the same, when the borosilicate glass film 324, 328 whose main components is silicon dioxide is formed, resulting in good wettability.

Further, in case of the embodiment shown in FIG. 12*a*, the silicon dioxide film is formed by thermal oxidation, the corners 330, 331 of the diaphragm 310 are round so that a stress is hardly concentrated at the corners. The silicon dioxide film is formed by reaction (thermal oxidation) between silicon and supplied oxygen in heating atmosphere. At the begging of thermal oxidation, silicon atoms in the surface of silicon react with oxygen atoms to form silicon dioxide film on the surface of the silicon. As the reaction proceeds, oxygen atoms do not directly touch the silicon atoms because of the silicon dioxide. Thus, oxygen atoms diffuse in the silicon dioxide film and arrive at the interface between the silicon and the silicon dioxide film to react with silicon atoms. Accordingly, the progress of thermal oxidation depends on diffusion of oxygen atoms in the silicon dioxide film. At the corners of the film, round portions are formed so as to make an equal concentration and diffusion distance of diffused oxygen as those of the flat portion. Since the corner 332 of bonded portion of the ink chamber substrate 200 does not touch with the diaphragm film 323, which is a vibrating portion of the diaphragm 301, the stress does not concentrate. Therefore, as shown in FIG. 13*a*, if the diaphragm film vibrates, repeating stress fatigue does not occur at the stress concentrated position. On the other hand, in case of the comparative diaphragm shown in FIG. 13*b*, since a stress concentrates at the corner 332 of the ink chamber substrate 200 when it touches with the diaphragm film 323, the repeating stress fatigue occurs in the vibrating diaphragm film to lessen the life of the film.

Thus, the diaphragm film, which is disposed inside of the diaphragm substrate, attains reliability for a long period of time.

According to the embodiments described above, when the diaphragm substrate is prepared by the dry-etching method, the pitch of the diaphragms can be made small; and if the diaphragm film is silicon dioxide, the thickness of the diaphragm can be constant. When the diaphragm film is disposed in the silicon wafer, high reliability of the diaphragm for a long time of period and a high yield rate of the products are attained.

According to the embodiments of the method of manufacturing the diaphragm substrate, the diaphragm film formed inside of the diaphragm substrate does not touch with the corners of the bonded portions of the diaphragm substrate so that breakage of the diaphragm film due to repeating stress concentration is avoided and high reliable inkjet heads can be provided.

If the diaphragm film bends, it does not project from the surface of the diaphragm substrate, the destroying of the diaphragm during handling of the diaphragm substrate and bonding or adhering of the diaphragm substrate to the ink chamber substrate is avoided to increase the yield rate of the products.

The embodiments of the method of manufacturing the diaphragm substrate according to the present invention that uses also the dry-etching process can conduct processing of holes perpendicularly, thereby to lessen the pitch of the diaphragms. Thus, a high, precise printing can be achieved.

The dry-etching process makes even curved portions worked so that almost the optimum structure of the diaphragm is manufactured.

The diaphragm of the embodiments according to the present invention that uses the silicon dioxide film as the diaphragm has a constant thickness over the whole film. Therefore, fluctuation of a jetted volume and jetting speed of ink from the nozzles is small, whereby high precision printing becomes possible.

Figure 14:
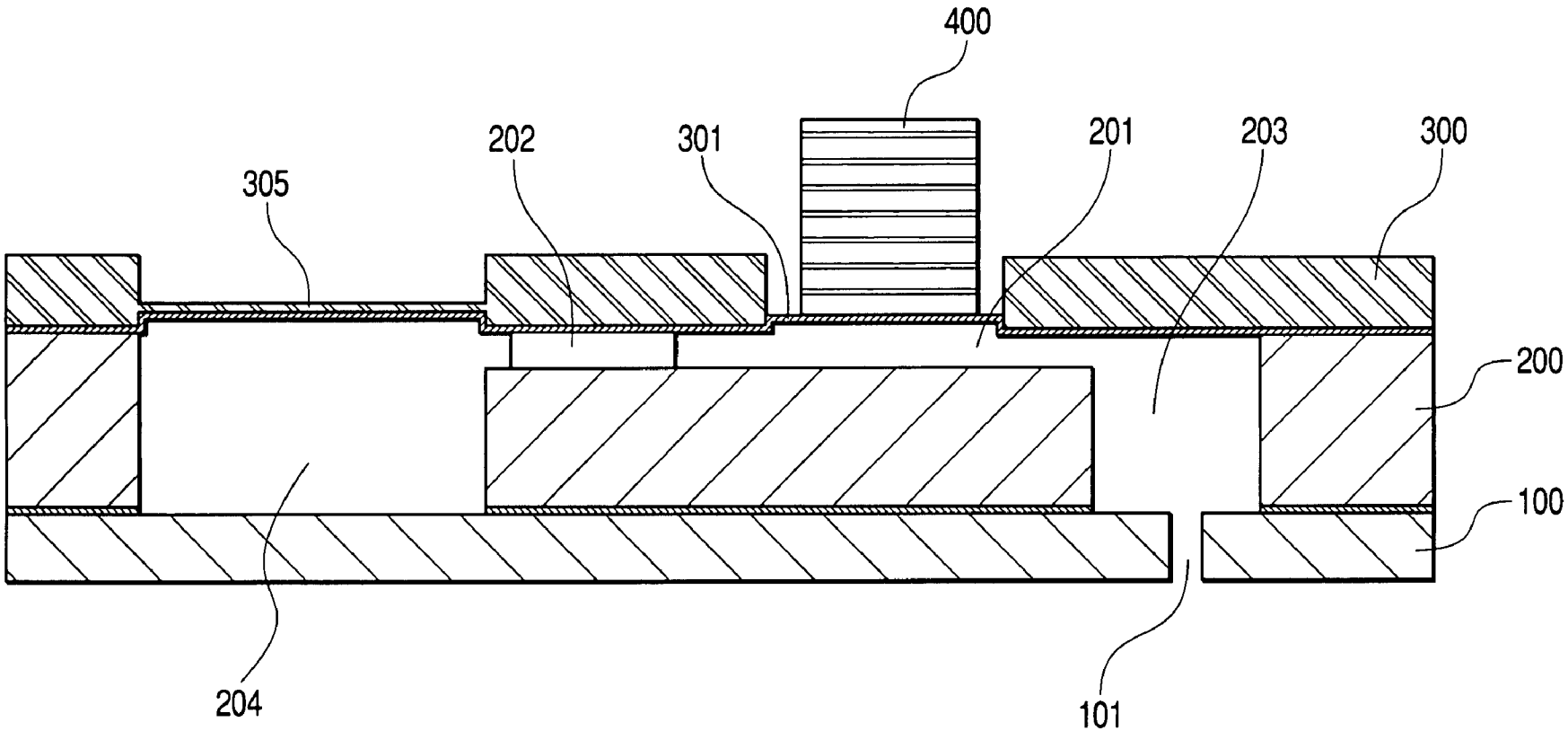
FIG. 14 is a cross sectional view showing the inner structure of the inkjet head according to the present invention.

FIG. 14 is a cross sectional view of an inkjet head of another embodiment according to the present invention, wherein the nozzle substrate 100, chamber substrate 200 and diaphragm substrate 300 are laminated. The nozzle substrate 100 is provided with nozzles 101. The chamber substrate 200 is provided with a through hole 203, an ink storage 204, a restrictor 202 and a pressure chamber 201. The diaphragm substrate 400 is provided with a damper plate 305 and the diaphragm 301. The piezo element 400 is bonded to the diaphragm 301. The nozzle substrate 100, chamber substrate 200 and diaphragm substrate 300 are laminated on the ink storage 204, pressure chamber 201 and through-hole 203 to constitute a space. The nozzle substrate 100 and chamber substrate 100 are bonded by anodic bonding process. The chamber substrate 200 and diaphragm substrate 300 are also bonded by anodic bonding process.

The diaphragm substrate of the embodiments according to the present invention that uses reinforcing films such as titanium film, chromium film, gold film, ceramic films or the like prevents breakage or destroy of the diaphragm film. It is also possible to make the diaphragm film thinner, so that the diaphragm film becomes more flexible and the vibration amplitude of the diaphragm film can be made larger. Further, since the following of the vibration to the inkjet performance is increased, it is possible to jet ink at a high speed and to perform a high speed printing. That is, the smaller the thickness of the diaphragm film, the better the vibration of the diaphragm film follows the vibration of the piezo element. As a result, the vibration performance (less lowering of speed) of the diaphragm film at a high frequency (high speed jetting) becomes better.

According to the inkjet heads of the embodiments of the present invention, since the diaphragm substrate is made of silicon, which is of corrosion resistance, even a corrosive liquid can be used. Thus, the inkjet heads of the embodiments can be used for various reagents, strong acidic liquids for organic electro-luminescence materials.

What is claimed is:

1. An inkjet head comprising:

a chamber substrate for forming an ink flow passage;

a diaphragm substrate including a diaphragm for pressurizing a pressure chamber disposed in the chamber substrate; and a nozzle substrate for jetting ink pressurized by the diaphragm, wherein the diaphragm substrate is made of silicon, the diaphragm is made of a material selected from the group of silicon oxide film and metal film, and the diaphragm is formed on an inner wall of a diaphragm groove formed in the diaphragm substrate.

2. The inkjet head according to claim 1, wherein the material of the diaphragm is the same as that of a film formed in the ink flow passage.

3. The inkjet head according to claim 1, wherein the diaphragm of the diaphragm substrate is formed at a position remote from the ink flow passage.

4. The inkjet head according to claim 1, wherein the diaphragm which is bonded to the chamber substrate has a borosilicate glass film or a combination of a metal film and the borosilicate glass film at the bonding side.

5. The inkjet head according to claim 1, wherein the material of the diaphragm is silicon oxide, and metal films are formed at both sides of the silicon dioxide.

6. The inkjet head according to claim 1, wherein the diaphragm has a part of the periphery of a curved line when viewed from the top plan thereof.

7. An inkjet printer, which comprises:

a row of heads;

a recording medium supplier;

a controller for controlling the inkjet heads; and a set of color ink supplying passages, wherein each of the heads has a plurality of inkjet heads, and wherein each of the inkjet head comprises a chamber substrate for forming an ink flow passage, a diaphragm substrate including a diaphragm for pressurizing a pressure chamber disposed in the chamber substrate, and a nozzle substrate for jetting ink pressurized by the diaphragm, wherein the diaphragm substrate is made of silicon, the diaphragm is made of a material selected from the group of silicon oxide film and metal film, and the diaphragm is formed on an inner wall of a diaphragm groove formed in the diaphragm substrate.

8. The inkjet printer according to claim 7, wherein the diaphragm of the diaphragm substrate is formed at a position remote from the ink flow passage.

* * * * *